United States Patent [19]

Kinoshita et al.

[11] Patent Number: 4,650,691

[45] Date of Patent: Mar. 17, 1987

[54] ELECTROLESS COPPER PLATING BATH AND METHOD

[75] Inventors: Akemi Kinoshita, Higashiosaka; Ken Araki, Ibaragi; Hidemi Nawafune, Takatsuki; Shozo Mizumoto, Takarazuka, all of Japan

[73] Assignee: C. Uyemura & Co., Ltd., Osaka, Japan

[21] Appl. No.: 653,848

[22] Filed: Sep. 24, 1984

[30] Foreign Application Priority Data

Sep. 28, 1983 [JP] Japan ..... 58-179778

[51] Int. Cl.[4] ..... C23C 18/40

[52] U.S. Cl. ..... 427/8; 106/1.23; 106/1.26; 427/437; 427/443.1

[58] Field of Search ..... 106/1.23, 1.26; 427/437, 443.1, 92, 98

[56] References Cited

U.S. PATENT DOCUMENTS

| | | | |
|---|---|---|---|
| 4,096,301 | 6/1978 | Slominski et al. | 427/437 X |
| 4,171,225 | 10/1979 | Molenaar et al. | 106/1.23 |
| 4,548,644 | 10/1985 | Nakaso et al. | 106/1.23 |

FOREIGN PATENT DOCUMENTS

| | | | |
|---|---|---|---|
| 68033 | 6/1977 | Japan | 106/1.23 |

*Primary Examiner*—John D. Smith

*Attorney, Agent, or Firm*—Birch, Stewart, Kolasch and Birch

[57] ABSTRACT

An electroless copper plating bath is prepared by adding both a metal-cyano-complex used as a stabilizer and an agent for complexing the metal of the metal-cyano-complex to an electroless copper plating bath containing cupric ion, an agent for complexing the cupric ion and a reducing agent, and an article to be plated is immersed in the bath.

26 Claims, 13 Drawing Figures

(1)

(2)

(3)

ELECTROLESS COPPER PLATING BATH AND METHOD

BACKGROUND OF THE INVENTION

This invention relates to an electroless copper plating bath and an electroless copper plating method which can stably provide an electroless copper plating deposit having excellent appearance and physical properties.

Conventionally, for the purpose of preventing any self decomposition of an electroless copper plating bath and forming a dense electroless copper plating deposit having a proper luster by catching minute particles of a catalyst metal developed in the bath and sequestering cuprous ion $Cu^{+}(I)$ developed in the reaction, a slight quantity (usually ppm order to 10 ppm order) of a cuprous-ion-complexing agent which forms Cu(I)-halogen, Cu(I)-N, Cu(I)-S complexes or the like is used as a stabilizer.

Among these stabilizers, cyanides are known to have an excellent effect on forming a highly dense electroless copper plating deposit and stabilizing the electroless copper plating bath. In particular, a metal-cyano-complex such as $K_2[Fe(CN)_6]$, $K_2[Ni(CN)_4]$ or $K_3[Co(CN)_6]$ has a wider permissible range of the addition amount to the bath than other stabilizers and the addition of an excess amount of the metal-cyano-complex causes little influence to the deposition rate. That is to say, a metal-cyano-complex, in contrast with other stabilizers used in electroless copper plating, has little possibility of a very small concentration having a great influence on the appearance, the surface condition and the physical properties of the plating deposit as well as the deposition rate and the deposition condition by firmly adhering or adsorbing to the surface of the plating deposit and inhibiting its catalytic activity.

However, a metal-cyano-complex stabilizer has the disadvantage of not lasting long. For example, the stabilizing effect of a metal-cyano-complex stabilizer is lost or greatly reduced during use and even before use if the bath is left to stand. In general, when the stabilizing effect of the stabilizer is lost, a plating reaction can not be suppressed and the plating rate increases, forming a rough deposit and even inducing decomposition of the bath. The stability of the bath can be restored by adding a required quantity of a non-metal-cyano-complex stabilizer. In contrast, in a metal-cyano-complex stabilizer, stoppage of plating reaction is caused when the stabilizing effect is lost and it can not be restored by addition of the metal-cyano-complex, resulting in discarding the electroless copper plating bath at the worst. Due to this the use of a metal-cyano-complex, despite its excellent characteristics as a stabilizer for electroless copper plating, is not practical.

SUMMARY OF THE INVENTION

An object of this invention is to provide an electroless copper plating bath and an electroless copper plating method in which a metal-cyano-complex can be effectively used as a stabilizer by preventing any stoppage of plating reaction which might be caused by using the above complex.

The inventors consider that the problems arising from the use of a metal-cyano-complex are caused by cyane ion and metal ion liberated due to the dissociation (decomposition) of the complex itself by adhering or adsorbing the surface of an article to be plated or the surface of the plating deposit (the surface of autocatalytic reaction). Therefore, the inventors attempted to prevent any adverse effect by masking the metal of the complex. As a result, the inventors have found that effective electroless copper plating can be carried out with a metal-cyano-complex left to stand over a long period in the bath without causing stoppage of plating reaction by adding a complexing agent such as triethanolamine which can complex the metal of the metal-cyano-complex. This effectively masks metals such as iron, cobalt and nickel in alkaline solution and is particularly effective with iron. In addition, we have found that the physical properties of an electroless copper plating deposit such as elongation are improved by addition of an agent for complexing the metal of the metal-cyano-complex and that the improvement of the physical properties is more significant as a larger quantity of the metal-cyano-complex is blended.

Thus, this invention provides an electroless copper plating bath prepared by adding both a metal-cyano-complex used as a stabilizer and an agent for complexing the metal of the metal-cyano-complex to an electroless copper plating bath containing cupric ion, an agent for complexing the cupric ion, and a reducing agent, as well as an electroless copper plating method in which an article to be plated is immersed in the above mentioned bath.

According to this invention, owing to the use of a metal-cyano-complex as a stabilizer and the addition of an agent for complexing the metal of the metal-cyano-complex, no inconveniences such as stoppage of plating reaction are caused during use of the bath or even after it is left to stand over a long period of time and the metal-cyano-complex constantly exhibits its effective stabilizing effect, thereby enabling stable effective electroless copper plating. In addition, an electroless copper plating deposit of good physical properties and a high elongation percentage can be obtained.

According to a preferred embodiment of this invention, an electroless copper plating bath additionally containing a water-soluble nitrogen compound which has two or more polar groups at least one of which is the $-NH_2$ group or the $=NH$ group and which can react with formaldehyde or its derivative to form an addition product, is provided. Such a plating bath gives a smooth and dense plating deposit with a good luster and enables very smooth removal of a resist film. Furthermore, with such a bath, the deposition rate and the physical properties of the deposit can be easily controlled.

The above and other objects, features and advantages of the invention will become more apparent from the following description.

BRIEF DESCRIPTION OF DRAWINGS

Each of FIGS. 1 to 3 is a rough diagram illustrating an example of the system of this invention.

DETAILED DESCRIPTION OF THE INVENTION

Figure 1:
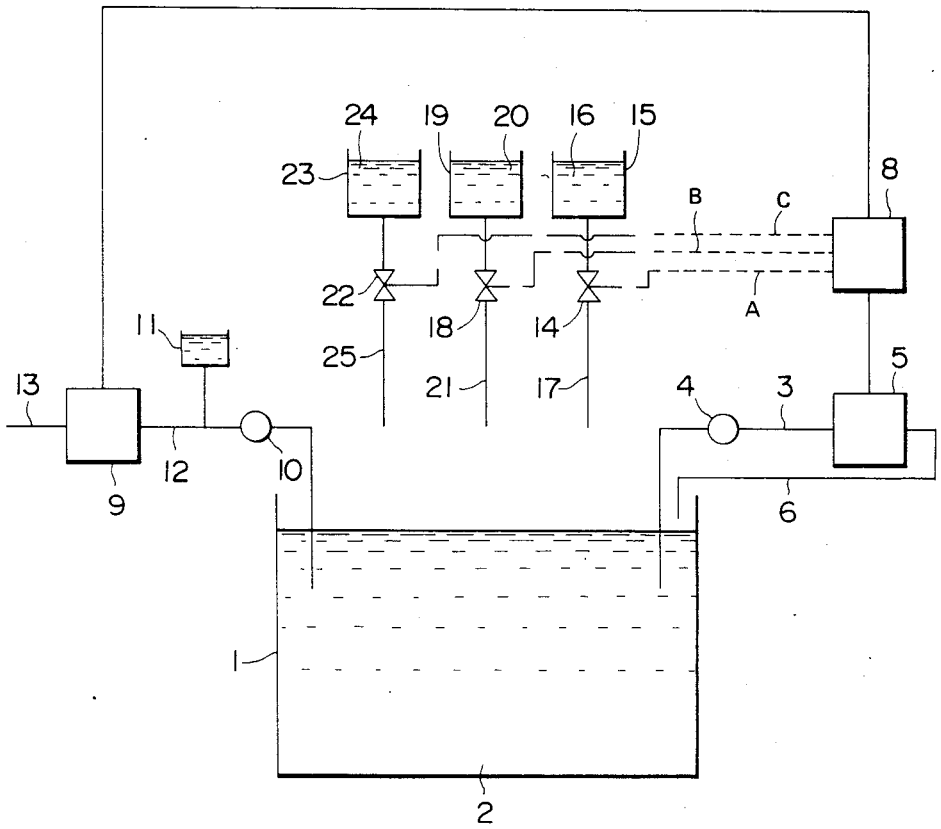

An electroless copper plating bath used in this invention contains cupric ion, an agent for complexing the cupric ion and a reducing agent.

Cupric ion is supplied by copper sulfate or the like. As the agent for complexing cupric ion, the following compounds are listed for example in which ethylenediamine derivatives are specially preferred: ethylenediamine derivatives such as ethylenediaminetetraacetic acid, tetrahydroxy propyl ethylenediamine, N-hydroxy ethyl ethylenediaminetriacetic acid and the salts of these compounds; diethylenetriaminetriacetic acid, diethylenetriaminepentaacetic acid, nitrotriacetic acid, cyclohexylenediaminetetraacetic acid, citric acid, tartaric acid and the salts of these compounds. In addition, as the reducing agent in this invention, formaldehyde or its derivative is preferably used.

In the bath according to this invention, it is preferred that the concentration of cupric ion is 0.01 to 1 mole/l, preferably 0.02 to 0.5 mole/l, that the molar concentration of the cupric-ion complexing agent is equal to or higher than the molar concentration of cupric ion and that the concentration of the reducing agent is 0.02 to 0.5 mole/l preferably 0.02 to 0.1 mole/l.

The bath according to this invention contains, in addition to the said components, a metal-cyano-complex used as a stabilizer as well as an agent for complexing the metal of the metal-cyano-complex.

As the metal-cyano-complex, the water-soluble cyano-complexes of the group VIII metals are preferred. Particularly, ammonium ferrocyanide, alkali metal ferrocyanides such as potassium ferrocyanide ($K_4[Fe(CN)_6]$), ammonium nickelcyanide, alkali metal nickelcyanides such as potassium nickelcyanide ($K_2[Ni(CN)_4]$), ammonium cobaltcyanide and alkali metal cobaltcyanides such as potassium cobaltcyanide ($K_3[Co(CN)_6]$) are preferably used. Such a metal-cyano-complex may be used alone or in combination of two or more. It is preferred that the quantity of the metal-cyano-complex added is not less than $1\times10^{-5}$ mole/l, preferably $1\times10^{-5}$ to $5\times10^{-2}$ mole/l in the bath. As a larger quantity of the metal-cyano-complex is blended, the elongation percentage of an electroless copper plating deposit is further increased.

As an agent for complexing the metal of the metal-cyano-complex, an alkanol amine such as triethanolamine is preferably used. Such a complexing agent itself may complex cupric ion. However, in the bath according to this invention, the aforementioned complexing agent such as an ethylenediamine derivative, is used to complex cupric ion. Therefore, a compound which can not complex cupric ion under the existence of a cupric-ion complexing agent as the above agent for complexing the metal of the metal-cyano-complex.

It is preferred that the molar concentration of the above agent for complexing the metal of the metal-cyano-complex added is equal to or larger than the molar concentration of the metal-cyano-complex, preferably one to three times by mole. Addition of a quantity larger than the above, although causing no special problem, has no advantage.

The bath according to this invention, when necessary, may contain another stabilizer either in addition to or instead of the metal-cyano-complex. As the other stabilizer, compounds other than the metal-cyano-complex having a nitrogen atom which can bind to cuprous ion to form a complex, for example, cyanides such as sodium cyanide and potassium cyanide, thiocyanates such as potassium thiocyanate, pyridyl derivatives such as $\alpha,\alpha'$-dipyridyl and 2-(2-pyridyl) benzimidazole, phenanthroline and its derivatives such as 1,10-phenanthroline 4,7-diphenyl-1,10-phenanthroline and 2,9-dimethyl-1,10-phenanthroline and organic nitriles are listed. Among these compounds, sodium cyanide, potassium cyanide, $\alpha$, $\alpha'$-dipyridyl or 2,9-dimethyl-1,10-phenanthroline is preferably used.

The bath according to this invention, in addition to the above described components, may contain a water-soluble nitrogen compound which has two or more polar groups at least one of which is the $-NH_2$ group or the $=NH$ group and which can react with said formaldehyde or its derivative to form an addition product. When such a water-soluble nitrogen compound is used in combination with the stabilizer (a compound which can bind to cuprous ion to form a complex, including the metal-cyano-complex), concentrational variation of the stabilizer causes very small variations to the appearance, the surface condition and the physical properties of an electroless copper plating deposit and formation of a smooth dense plating deposit having a good luster is secured. Besides, deposition condition varies little according to time during plating, thereby enabling formation of a homogeneous plating deposit constantly having the same surface condition and appearance. In addition, in forming a resist film on the plating deposit in manufacturing a printed-wiring board, the resist film becomes in proper contact with the plating deposit and can be easily washed out. In the bath containing both the stabilizer and the above nitrogen compound, the deposition rate and the physical properties of a plating deposit are easily controlled. That is to say, control of the deposition rate of electroless copper plating is achieved by controlling the molar ratio of the above nitrogen compound to formaldehyde. Here, variation in the concentration of the said stabilizer has almost no influence on the deposition rate. Besides, physical properties of constant levels can be achieved by maintaining a constant deposition rate.

This point will be described in more detail in the following. Since the above described stabilizer firmly adheres or adsorbs to the deposition surface of the plating deposit, covers its surface and thereby inhibits its catalytic activity, even a very low concentration of the stabilizer greatly influences deposition conditions such as the appearance, the surface condition and the physical properties of the plating deposit as well as the deposition rate. The stabilizer contained in the bath is in a very much smaller quantity than the other components such as cupric ions, the complexing agent and the reducing agent. Besides, the stabilizer is analysed only with difficulty, and consumed during plating due to adsorption on the deposit or dragging out. Therefore, the concentration of such a stabilizer in the bath without the said nitrogen compound can be maintained constant with much difficulty and control of the concentration is difficult. As a result, the following inconveniences are frequently caused without the nitrogen compound: the appearance, the surface condition and the physical properties of each plating deposit film vary; and in performing plating over a long time, variations in deposition condition are caused in the same plating deposit, inhibiting formation of a homogeneous deposit. Such inconveniences have been great problems in terms of the quality of a printed-wiring board. In making a printed-wiring board by forming a resist film on an electroless copper plating deposit formed with the bath without said nitrogen compound and removing the resist film in the final stage, due to the difference in deposition condition of each deposit, condition for removing the resist film can not be set constant and variation in ease of removal of the resist film is sometimes caused. The resist film may be removed by washing it once in some cases, while it can not be removed after washing several times in other cases. Thus there has been great problem in terms of removal of the resist film as well.

However, according to the study of the inventors, the above described problems can be solved by the combination of a stabilizer which can a form Cu(I)-N complex and a water-soluble nitrogen compound such as glycine or sarcosine which has two or more polar groups at least one of which is the $—NH_2$ group or the $=N_2H$ group and which can react with said formaldehyde or its derivative to form an addition product.

As such a water-soluble nitrogen compound as mentioned above, an amine or an imine is used. The compound may complex cupric ion by itself. However, in the bath according to this invention, as described above, cupric ion is complexed by the complexing agent and the above nitrogen-containing complex can never act as an agent for complexing cupric ion under the existence of the complexing agent.

As examples of the nitrogen compound, the following compounds are listed: aliphatic polyamines such as ethylenediamine, diethylenetriamine, triaminoethylamine and triethylene tetramine; aliphatic amino alcohols such as monoethanolamine, N-aminoethyl ethanol amine and -amino-2-propanol; aliphatic amino ethers such di(2-aminoethyl)ether; aliphatic amino-carboxylic acids such as glycine, alanine and amino-butyric acid; aliphatic amino ketones; amino-sulfonic acid; aminophosphoric acid; and other amines; aliphatic iminocarboxylic acids such as sarcosine, N-ethyl glycine and iminodiacetic acid; aliphatic imino alcohols such as diethanolamine; imino-ethers; imino-ketones; imino-sulfonic acid; imino-phosphonic acid; and other imines.

The combination of such a nitrogen compound and the specified stabilizer enables formation of a smooth, lustrous and dense electroless copper plating deposit which has good physical properties and enables a resist film to be easily removed from it. Therefore an amino-carboxylic acid or imino-carboxylic acid such as glycine or sarcosine may be effectively used. That is to say, according to the observation of the inventors, among water-soluble nitrogen compounds having two or more polar groups at least one of which is the $—NH_2$ group or the $=NH$ group, the use of an aliphatic compound having the $—NH_2$ group or the $=NH$ group and the —COOH group such as glycine or sarcosine alone results in formation of an electroless copper plating deposit having inferior appearance and surface condition and enabling inferior removal of a resist film. However, the combination of such a nitrogen compound and a specified stabilizer enables formation of an electroless copper plating deposit with high characteristics. Besides, even if there are concentrational variations of the nitrogen compound and the stabilizer, they have little influence on the characteristics of the deposit, thereby enabling stable formation of a homogeneous electroless copper plating deposit having excellent physical properties. Therefore an amino-carboxylic acid or an imino-carboxylic acid which has the $—NH_2$group or the $=NH$ group and the —COOH group and which alone does not enable formation of a good deposit can be effectively used.

It is preferred that the quantity of the above nitrogen compound for 1 mole quantity of total formaldehyde is 0 to 2 moles, desirably, 1 to 2 moles, preferably 0.4 to 1.2 moles.

It is preferred that the pH of the bath of this invention is higher than 7, preferably within the range of 11 to 13.5, more preferably within the range of 11.5 to 12.5.

In plating, an article is immersed in the above mentioned bath. As the article to be plated, a pretreated substrate for a printed-wiring board, a plastic molding, a ceramic article or the like is used. As to the temperature of plating, room temperature to 80° C., preferably 45° to 75° C. may be adopted. Plating time is appropriately set according to the required thickness of the deposit, the deposition rate of the bath and the like.

The deposition rate of the bath according to this invention can be controlled by varying the composition of the bath, especially the quantity of the metal-cyano-complex added, the pH of the bath, plating temperature and the like. It is preferably controlled generally within the range of 1 to 6 $\mu m/h$.

Further description will be given on control of the deposition rate and that of the physical properties of a deposit in performing electroless copper plating according to this invention. The concentration of cupric ion, the pH of the bath, plating temperature and the like can be controlled by the usual method. When the water-soluble nitrogen compound which can react with formaldehyde or its derivative to form an addition product is added, it is preferred that the concentration of free formaldehyde which is not formed as the addition product with the compound and exists in HCHO as it is in the bath is controlled.

According to the results of the inventors' study, in the bath containing a compound which can react with formaldehyde or its derivative to form an addition product, the deposition rate and the physical properties of the deposit both are almost linearly dependent on the concentration of free formaldehyde. As the concentration of free formaldehyde increases, the deposition rate increases almost linearly and, the physical properties especially the elongation percentage and the tensile strength of the deposit decrease almost linearly. Therefore, easy determination of the deposition rate and the physical properties is secured through the concentration of free formaldehyde. As a result, the deposition rate and the physical properties can be maintained within a given range by maintaining the concentration of free formaldehyde within a given range and they can be adjusted to desired levels through appropriate selection of the concentration of free formaldehyde, thereby enabling the deposition rate and the physical properties to be easily controlled freely through control of the concentration of free formaldehyde.

Accordingly, in carrying out electroless copper plating in solution containing cupric ion, an agent for complexing cupric ion, formaldehyde or its derivative and a compound which can react with formaldehyde or its derivative to form an addition product, it is preferred that the deposition rate of the above electroless copper plating and the physical properties of the deposit is maintained at constant levels by maintaining a constant concentration of free formaldehyde which is not formed as the addition product and exists in HCHO as it is. In carrying out such a method, it is not necessary to control the concentration of total formaldehyde, the concentration of a compound which can react with formaldehyde or its derivative to form an addition product and the molar ratio of this compound to formaldehyde. The deposition rate and the physical properties, being proportional to the concentration of free formaldehyde irrespective of these concentrations and molar ratio, can be controlled through simple control of the concentration of free formaldehyde, thereby enabling very easy control of electroless copper plating. In addition, desired deposition rate and physical properties can be easily obtained by maintaining an appropriately selected concentration of free formaldehyde.

The concentration of free formaldehyde can be determined through the application of polarography, a volumetric method or the like. Therefore according to the results of continuous or intermittent determinations of the concentration of free formaldehyde in the electroless copper plating solution carried out by such a quantitative method, a necessary quantity of formaldehyde or its derivative or a compound which can react with formaldehyde or its derivative to form an addition product is appropriately supplied so as to maintain the concentration of free formaldehyde at a constant level.

In terms of ease of control as well as security in the control of the deposition rate and the physical properties, it is recommended that the concentration of free formaldehyde is maintained at a given level within the range of 0.01 to 0.5 mole/l, preferably 0.01 to 0.1 mole/l.

In carrying out the plating method according to this invention, the pH or alkalinity of the bath can be controlled by the usual method in which a pH meter is used for example. When an ethylenediamine derivative is used as an agent for complexing cupric ion the pH or alkalinity of the above plating solution can be determined according to the results of the following determinations: the absorbance of the above plating solution is measured at a pH higher than 8; and the concentration of copper ion in the above plating solution is measured. In the plating solution in which an ethylenediamine derivative is used as a complexing agent, since the absorbance level and the pH level of the plating solution with constant copper concentration are interrelated at a pH higher than 8, preferably at pH 9 to 14, the pH or alkalinity of the plating solution can be accurately determined by measuring its absorbance at a pH higher than 8 as far as copper concentration is constant. Thus, the pH or alkalinity of the plating solution containing an ethylenediamine derivative as a complexing agent can be determined according to the results of both measurement of the absorbance of the plating solution at a pH higher than 8 and measurement of the concentration of copper ion in the solution. Here, a wavelength at which the absorbance is measured is selected according to the kind of a complex compound between copper and an ethylenediamine derivative. However, it is preferred that the measurement is carried out at the absorption wavelength of the above complex compound, and a given wavelength within the range of 680 to 800 nm can generally be adopted. For instance, in a complex compound between copper and ethylenediaminetetraacetic acid or its alkali metal salt, a wavelength of around 730 nm may be used.

This method is advantageous in that, since no pH meters are used, even continuous or long-period determinations of the pH of the highly alkaline solution can be performed with a sufficient reproducibility without causing any troubles.

In conducting this method of determining pH or alkalinity, the relationship between the absorbance and the pH levels is obtained on solutions containing a copper-ethylenediamine derivative complex and having various copper-ion concentrations. After that, the pH of solution containing a copper-ethylenediamine derivative complex is obtained from its absorbance according to the relationship between the absorbance and the pH levels corresponding to the copper ion concentration of the above solution. The pH level can be conveniently determined from the absorbance level by utilizing a pH-absorbance calibration curve. The pH level to be determined can be computed from the measured absorbance by storing this calibration curve in a computer. The pH level termed here may be any numerical values clearly indicating changes in alkalinity within the range of use, and there is no need to keep to the absolute pH value which is defined as the logarithm of the inverse number of the activity of hydrogen ion. In addition, whether the pH level of the solution is higher or lower than a given pH level can be determined simply by, for example, comparing the measured absorbance of the solution with a given absorbance (=given pH level) before the result of the comparison is known through a signal. Therefore, control of the pH or alkalinity of the electroless copper plating solution is secured by giving a signal when the measured level is less than a preset pH level or alkalinity.

Figure 2:
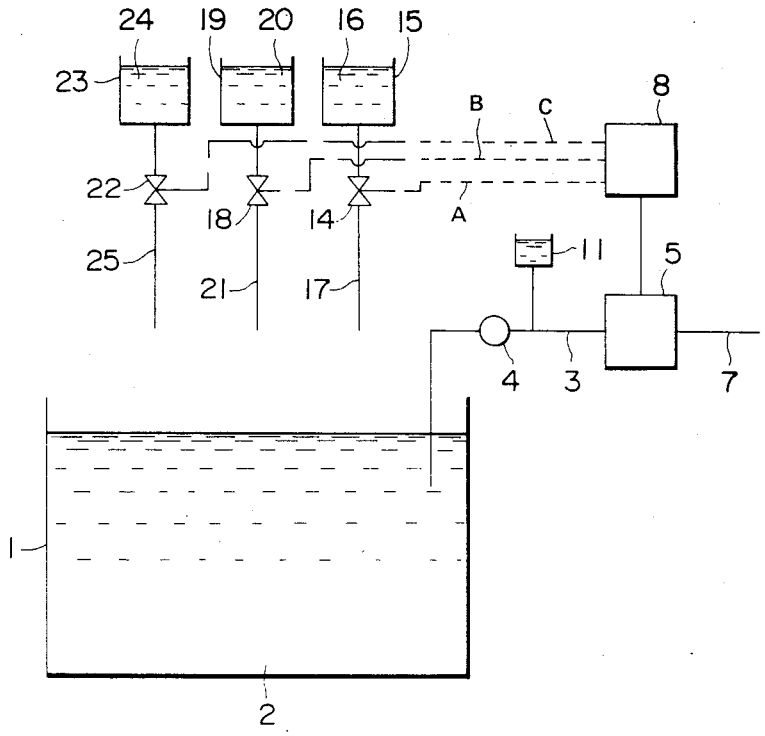

This is shown by examples illustrated in FIGS. 1 and 2. In these figures, the numeral (1) represents an electroless copper plating tank for an electroless copper plating solution (2) and the numeral (3) represents a pipe in which a pump (4) is installed. One end of the pipe (3) is immersed in the plating solution (2) and the other end is connected to an absorbance-measuring device (5). According to these examples, the plating solution (2) contained in the tank (1) flows into the pipe (3) continuously or at given time intervals through the operation of the pump (4), thereafter flowing through the flow cell of the device (5) so as to measure the absorbance of the plating solution (2). Here, plating solution used for determination of the absorbance may be fed back to the tank (1) through a pipe (6) or may be discarded outside the system through a pipe (7).

The thus measured absorbance is compared with a preset level in a control device (8), and a signal (A) is given when the pH or alkalinity of the plating solution determined from the above measured absorbance is lower than a preset pH or alkalinity level. Determination of the concentration of copper ion in the plating solution is necessary for determining the pH or alkalinity of the plating solution from the above measured absorbance.

Determination of the concentration of copper ion in the plating solution, although not specially restricted, is preferably performed by absorption photometry.

The concentration of copper ion in the plating solution is measured by absorption photometry after the pH of the plating solution is adjusted to below 8 by addition of an acid such as sulfuric acid, hydrochloric acid or acetic acid. A measurement wavelength can be appropriately selected, for example, within the range of 680 to 800 nm. Since the absorbance and the level of copper ion concentration are in almost linear interrelation at the given wavelength, the concentration of copper ion in the solution can be determined from the result of such measurement mentioned above. Another device may be specially installed in addition to the absorbance-measuring device (5) for measurement of the absorbance of the plating solution adjusted to below pH 8. Alternatively, the device (5) may be used for measurement of the absorbance of the above solution as well.

In the example illustrated in FIG. 1, an absorbance-measuring device (9) for the plating solution adjusted to below pH 8, is specially installed. One end of a pipe (12) is immersed in the plating solution (2), a pump (10) and an acid-adding device (11) are installed in the pipe (12) in that order, and the other end of the pipe (12) is connected to the device (9). Almost at the same time when the absorbance of the plating solution (2) is measured with the device (5), an acid is added from the device (9) to part of the plating solution (2) fed into the pipe (12) through the operation of the pump (10) to adjust the pH of the plating solution to below 8 before its absorbance is measured with the other absorbance-measuring device (9). It is preferred that plating solution used for measurement of the absorbance is discarded outside the system through a pipe (13).

In the example illustrated in FIG. 2, the absorbance-measuring device is commonly used and an acid-adding device (11) is connected to the pipe (3). The absorbance of the plating solution itself is measured, without adding an acid., for determination of the pH or alkalinity. In measuring the absorbance for determination of the concentration of copper ion in the plating solution immediately after or before the above measurement an acid is added from the acid-adding device (11) to adjust the pH of the plating solution to below 8.

The thus obtained absorbance of the plating solution adjusted to below pH 8 is subjected to an operation in the control device (8), thereby obtaining the concentration of copper ion in the plating solution. The thus obtained copper ion concentration and the absorbance of the plating solution at a pH higher than 8 are subjected to an operation and its result is compared with a set level. When the pH or alkalinity of the plating solution obtained through this operation is lower than a preset pH or alkalinity level, the signal (A) is given. Therefore, a computer having storing, computing and comparing functions can be effectively used as the control device (8). In addition to giving the signal (A) when the pH or alkalinity of the plating solution is below a set level, it is possible to give the alarm by creating a signal when the pH or alkalinity is higher than a preset pH or alkalinity level.

The signal (A) may be given as a buzzer alarm or the like so that a worker can add a pH-adjusting agent to the plating solution according to necessity. However, it is preferred that a pH-adjusting agent is automatically supplied into the plating solution by delivering the signal (A) to a pH-adjusting-agent-supplying device.

This is shown in the examples illustrated in FIGS. 1 and 2. A given amount of a pH-adjusting agent (16) contained in a pH-adjusting-agent container (15) is added to the plating solution (2) contained in the tank (1) through a pipe (17) by opening an electromagnetic valve (14) for a given time by delivering the signal (A) to the valve (14). The pH-adjusting agent (16), although varied according to the composition of the plating solution, principally consists of an alkali hydroxide usually and ammonia in some cases.

In terms of control of the electroless copper plating solution, it is preferred that a signal (B) is given when the concentration of copper ion in the plating solution computed from the absorbance of the plating solution adjusted to below pH 8 is lower than a preset level of copper ion concentration by comparing the above absorbance with a preset level of absorbance in the said control device (8). Although the signal (B) may be given as a buzzer alarm or the like in the same manner as the signal (A), it is advantageous to carry out automatic supply of copper ion by delivering the signal (B) to an copper-ion-supplying device. That is to say, as indicated in the examples illustrated in FIGS. 1 and 2, it is preferred that a given amount of a copper-ion-supplying agent (20) contained in a copper-ion-supplying-agent container (19) is added to the plating solution (2) through a pipe (21) by delivering the signal (B) to an electromagnetic valve (18).

A pH-adjusting-agent and a copper-ion supplying device are not restricted to those illustrated in the figures, and a quantitative pump may be used for example.

In addition, in this invention, the concentration of a reducing agent (formalin) in the plating solution can be controlled by an appropriate quantitative method. In this case as well, the concentration of formalin can be determined by taking advantage of absorption photometry. Accordingly in this method, after the pH of the plating solution is adjusted to a given level for example to 7 to 10 by addition of an acid such as sulfuric acid or hydrochloric acid, the absorbance of the plating solution is measured. Next, a given quantity of a sulfite such as sodium sulfite is added to cause formalin to react with the sulfite, thereby producing alkali and increasing the pH of the plating solution. Following that an acid of known concentration is added until the absorbance of the plating solution coincides with the above absorbance before the concentration of formalin in the plating solution is computed from the amount of the acid of known concentration added, thereby quantitatively analzing formalin. When the concentration of formalin determined from the amount of the acid of known concentration added is lower than a preset formalin concentration either an alarm can be given, or formalin can be automatically supplied into the plating solution from a formalin-supplying device.

The quantity of formalin can also be obtained by measuring absorbance levels before and after the addition of the sulfite, and subjecting the measured absorbance levels to an operation carried out with a computer.

In addition, when the concentration of formalin can be calculated from that of copper ion because of the interrelation between the quantities of copper ion and formalin consumed, it is possible to supply formalin into the plating solution according to a signal (C) given at the same time as the signal (B) is given when the measured concentration of copper ion is below a set level.

This is shown in the examples illustrated in FIGS. 1 and 2. According to the signal (C) given simultaneously with the signal (B), an electromagnetic valve (22) is set open for a given time to supply, through a pipe (25), a given amount of a formalin-supplying agent (24) contained in a formalin-supplying-agent container (23) into the plating solution (2) contained in the tank (1). Formalin-supplying device is not restricted to the examples illustrated in the figures.

In general electroless copper plating, since the concentrations of copper ion and a reducing agent as well as the pH level decreases as the plating proceeds, it is recommended that these components supplied according to such decreases. Furthermore, as occasion demands, components such as a stabilizer and a complexing agent which is consumed by dragging out can be properly supplied by either mixing them into one of the aforementioned supply agents (16), (20) and (24) or separately from them.

Figure 3:
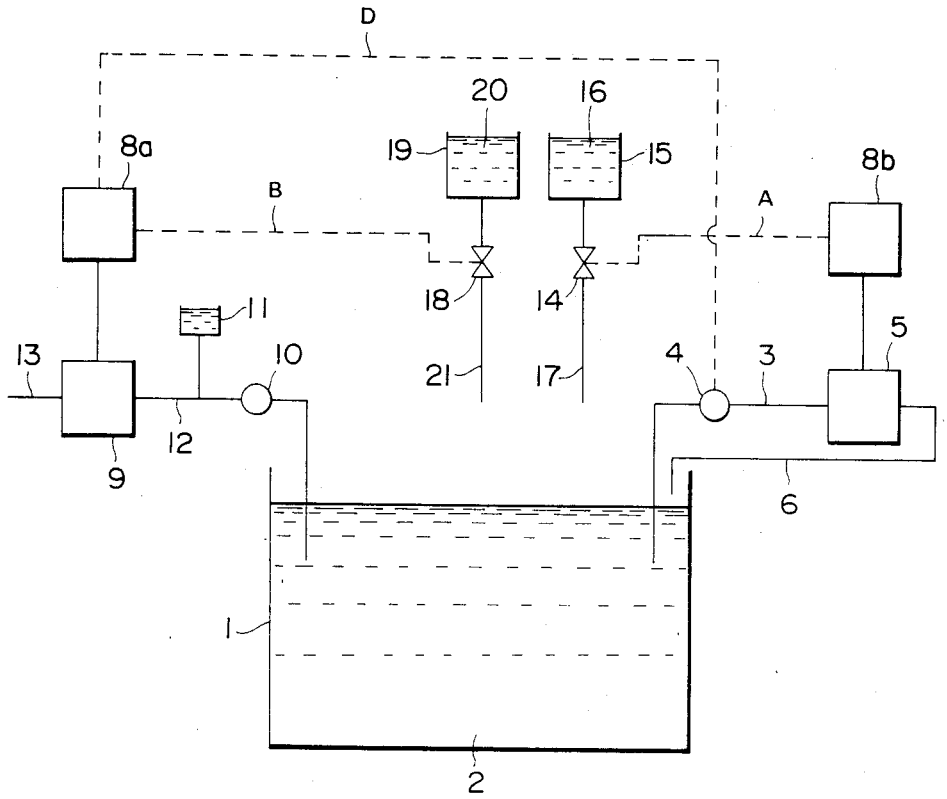

In the examples of FIGS. 1 and 2, the pH or alkalinity of the plating solution is computed in the control device (8) from the measured absorbance of the plating solution having a pH higher than 8 and the measured absorbance of the plating solution adjusted to below pH 8. However, this invention is not restricted by these examples. For example, the apparatus and method as illustrated in FIG. 3 is possible.

Figure 4:
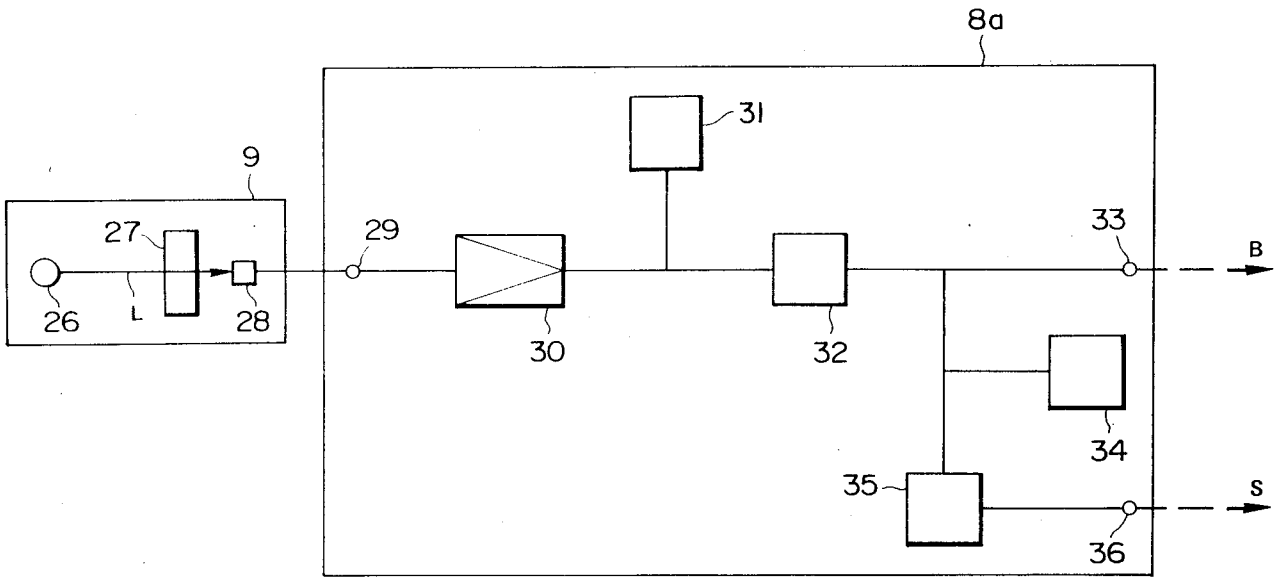
FIG. 4 is a block diagram illustrating the copper-ion-concentration absorbance-measuring device of the system shown in FIG. 3.

In the example illustrated in FIG. 3, after the absorbance of the plating solution adjusted to below pH 8 is measured in the absorbance-measuring device (9), the result of the measurement is compared with a set level in a control device (8*a*) and the signal (B) is given when the measured absorbance reaches a set level (when the concentration of copper ion in the plating solution becomes lower than a preset copper ion concentration). More tangible explanation will be given according to FIG. 4 in the following. In the absorbance-measuring device (9), light (L) discharged from a light source (26) is transmitted by a flow cell (27) in which the plating solution flows, and a change in light caused due to absorption by the plating solution is detected by a light-receiving element (28). Following that, a minute current flowing from the element (28) is delivered to the input terminal (29) of the above control device (8*a*), thereafter being amplified and converted into voltage in an amplifier (30), thereby displaying a voltage corresponding to the absorbance of the plating solution on a voltmeter (31). On the other hand, the output voltage of the amplifier (30) and a preset voltage are compared in a voltage-setting setting circuit (32) before the signal (B) is given from an output terminal (33) when the above output voltage reaches the set voltage. In addition to these devices, the above control device (8*a*) is provided with a counter (34) for counting times of delivery of the signal (B), and a delivery-times-setting circuit (35) for detecting every time when times of delivery of the signal (B) reaches a preset number. IN addition, a signal (S) is delivered from an output terminal (36) when times of delivery of the signal (B) reaches a given number, thereby determining the age of the plating solution (2).

The above signal (B) is transferred to a copper-ion-supplying device before the copper-ion-supplying agent (20) is supplied into the plating solution (2), thereby restoring the concentration of copper ion in the plating solution (2) to a given original level.

Accordingly, since the concentration of copper ion in the plating solution (2) is almost equal to the set copper ion concentration at the point when the above signal (B) is delivered and is restored to the original level after a given quantity of copper ion is supplied according to the signal (B) delivered, an almost constant copper ion concentration will be clearly detected at either of these points. Therefore when the signal (B) is given, the absorbance of the plating solution (2) itself (or plating solution adjusted to a pH level not lower than 8) is measured with the absorbance-measuring device (5) by the following method: the pump (4) is driven according to the signal (D) delivered from the control device (8*a*) before copper ion supply is carried out by delaying transfer of the signal (B) to the copper-ion-supplying device; or the pump (4) is driven (or the absorbance-measuring device (5) may be switched according to the signal (D) while constantly maintaining the pump (4) at the state of operation) according to the signal (D) delivered after copper ion is supplied according to the signal (B) given to the copper-ion-supplying device. In continuously analysing the concentration of copper ion in the plating solution (2), it is possible to give the signal (D) when the above concentration coincides with a preset copper ion concentration by installing another comparing circuit in addition to the above control device (8*a*).

Thus, the measured absorbance of the plating solution (2) of a pH higher than 8 is compared with a preset absorbance level (setpoint) in a control device (8*b*). When it reaches the setpoint, the signal (A) is given and is transferred to the electromagnetic valve (14) of a pipe (17) connected to the container (15) for the pH-adjusting agent (16). As a result, the valve (14) is opened for a given time thereby supplying a given quantity of the pH-adjusting agent (16) into the plating solution (2).

In the following, this invention will be tangibly explained according to examples although it should not be restricted to the following examples.

EXAMPLE 1

An electroless copper plating bath of the following composition was manufactured.

| | |
|---|---|
| $CuSO_4.5H_2O$ | 0.04 mole/l |
| EDTA.4Na | 0.08 mole/l |
| Formaldehyde | 0.03 mole/l |
| $K_4[Fe(CN)_6].3H_2O$ | $2 \times 10^{-3}$ mole/l |
| Triethanolamine | $3 \times 10^{-3}$ mole/l |
| pH (adjusted with NaOH) | 12.5 |

When plating was carried out with this plating bath at 70° C., an electroless copper plating deposit with a good appearance was deposited at the rate of about 4 μm/h.

For comparison, an electroless copper plating bath having the same composition as above but containing no triethanolamine was manufactured and plating was carried out at 70° C. As a result, after two hours of plating, precipitation of iron hydroxide was caused and deposition of copper was stopped. Since a plating bath is usually heated indirectly with a heater, temperature around the heater becomes considerably higher than bath temperature. Accordingly, the same phenomenon as mentioned above occured even when bath temperature was 50° C.

The deposition rate of the bath containing triethanolamine was the same as that of the bath without triethanolamine measured immediately after its preparation.

From the above results, it has been found that addition of triethanolamine stabilizes the bath and enables formation of a good plating deposit even after the bath is left to stand over a long period of time.

In addition, the elongation percentage of deposits obtained by use of plating baths as mentioned above containing $1\times10^{-4}$ mole/1,$2\times10^{-3}$ mole/1 and $1\times10^{-2}$ mole/1 each of $K_4[Fe(CN)_6].3H_2O$ and triethanolamine, were 3.8%, 5.35% and over 6% respectively. Thus, it has been found that an increased quantity of $K_4[Fe(CN)_6].3H_2O$ added remarkably improves the elongation percentage.

EXAMPLE 2

An electroless copper plating bath of the following composition was manufactured.

| | |
|---|---|
| $CuSO_4.5H_2O$ | 0.04 mole/l |
| EDTA.4Na | 0.06 mole/l |
| Glycine | 0.06 mole/l |
| Formaldehyde | 0.06 mole/l |
| $K_4[Fe(CN)_6].3H_2O$ | $3\times10^{-3}$ mole/l |
| Triethanolamine | $4\times10^{-3}$ mole/l |
| pH (adjusted with NaOH) | 12.5 |

When plating was carried out with this plating bath at 65° C., an electroless copper plating deposit with a good appearance was deposited at the rate of about 3 μm/h.

For comparison, an electroless copper plating bath having the same composition as above but containing no triethanolamine was manufactured and plating was carried out at 65° C. As a result, after two hours of plating, precipitation of iron hydroxide was caused and deposition of copper was stopped.

The elongation of the deposit obtained with the above bath containing triethanolamine was over 6%.

EXAMPLE 3

An electroless copper plating solution of the following composition was prepared.

| | |
|---|---|
| $CuSO_4.5H_2O$ | 0.04 mole/l |
| EDTA.4Na | 0.08 mole/l |
| Formaldehyde | 0.08 mole/l |
| Glycine | 0.04–0.12 mole/l |
| Potassium ferrocyanide | 0–100 ppm |
| Triethanolamine | 1.5 moles to 1 mole of potassium ferrocyanide |
| pH | 12.5 (adjusted with NaOH) |

After electroless copper plating was performed on a copper plate of $2\times2$ cm$^2$ used as a test piece at 70° C. for 60 minutes, the deposition rate was obtained from the change in weight of the test piece. The results are shown in FIG. 5, in which the lines (A), (B) and (C) represent results obtained with 0, 0.30 and 100 ppm of potassium ferrocyanide respectively.

Figure 5:
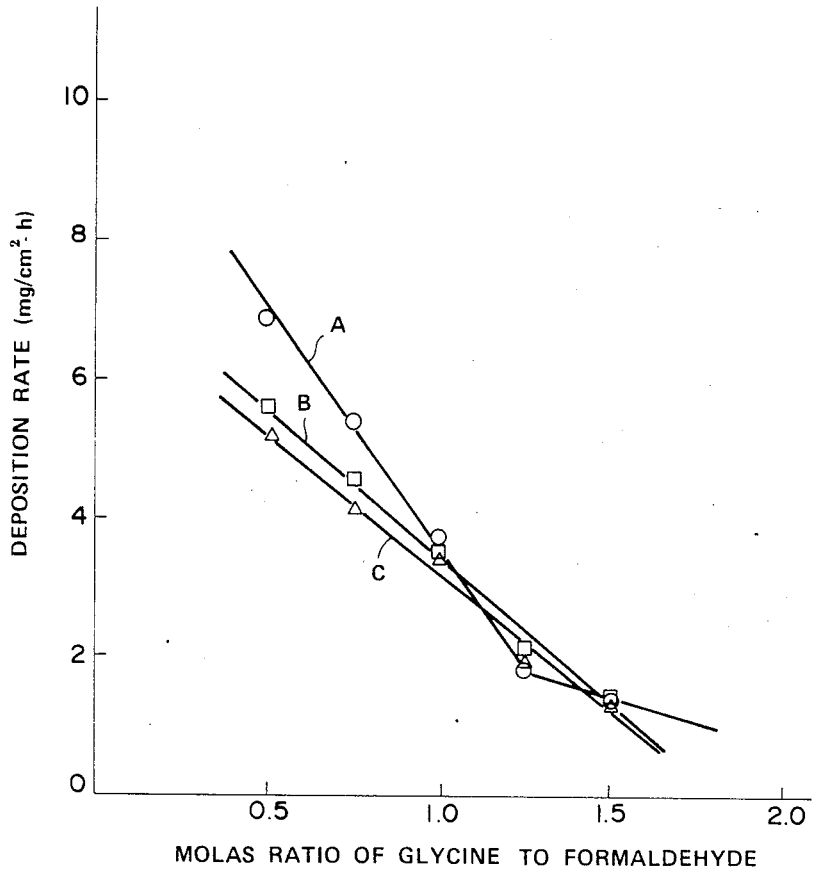
FIG. 5 is a graph indicating the relationships between the molar ratio of glycine to formaldehyde and the deposition rate of electroless copper plating under the existence and the non-existence of potassium ferrocyanide.

According to the results shown in FIG. 5, whether 30 ppm or 100 ppm of potassium ferrocyanide was added to the plating solution containing glycine caused almost no difference in the deposition rate, indicating that difference in the quantity of potassium ferrocyanide causes no significant difference in the deposition rate. Therefore it has been found that use of potassium ferrocyanide as a stabilizer facilitates control of the stabilizer. In addition, it has been found that the combination of glycine and potassium ferrocyanide enables the deposition rate to be easily controlled over a wide range of the molar ratio of glycine to formaldehyde.

EXAMPLE 4

An electroless copper plating solution (the bath according to this invention) of the following composition was prepared.

| | |
|---|---|
| $CuSO_4.5H_2O$ | 0.04 mole/l |
| EDTA.4Na | 0.08 mole/l |
| Formaldehyde | 0.08 mole/l |
| Sarcosine | 0.06 mole/l |
| Potassium ferrocyanide | 80 ppm |
| Triethanolamine | 1.5 moles to 1 mole of potassium ferrocyanide |
| pH | 12.5 (adjusted with NaOH) |

Next, a copper-plated glass epoxy laminar circuit board ($10\times10$ cm$^2$) used as a test piece was defatted and activated by the usual method, thereafter being immersed in 2 l of the above plating solution to perform electroless copper plating. Plating was performed at 70° C. for 60 minutes consecutively five times. For each plating, the copper ion and the formaldehyde concentrations and the pH of the plating solution were quantitatively analyzed before their consumption quantities were supplied in order to maintain constant copper ion and formaldehyde concentrations and pH level. Sarcosine, potassium ferrocyanide and triethanolamine were not additional supplied.

For comparison, a bath (reference bath I) having the same composition as the above plating solution but containing no potassium ferrocyanide and triethanolamine, and a bath (reference bath II, formaldehyde concentration of 0.04 mole/1) having the same composition as the above plating solution but containing no sarcosine and triethanolamine were prepared. Then plating was carried out in the same manner as above.

After a resist film of about 10 μm thickness was formed on a deposit obtained by the above method, this was immersed in a washing liquid at room temperature for two minutes per time so as to evaluate ease of removal of the resist film. A photoresist SMR-AT of the aqueous alkali solution development type (manufactured by Somal Industrial Company) was used, and 1% aqueous sodium hydroxide solution was used as the washing liquid.

The results of the bath according to this invention, reference baths (I) and (II) are indicated in Tables 1,2 and 3 respectively.

TABLE 1

| Bath According to This Invention | | | |
|---|---|---|---|
| Times of Plating | Deposition Rate mg/cm$^2$ · hr | Appearance and Surface Condition of Plating Deposit | Ease of Removal of Resist Film (Degree of Remaining Resist Film) |
| 1 | 4.4 | Slightly bright copper color, smooth, lustrous | Completely removed after washing twice |
| 2 | 4.4 | Slightly bright copper color, smooth, lustrous | Completely removed after washing twice |
| 3 | 4.4 | Slightly bright copper color, smooth, lustrous | Completely removed after washing twice |
| 4 | 4.3 | Slightly bright copper color, | Completely removed after washing twice |

TABLE 1-continued

| Times of Plating | Deposition Rate mg/cm$^2$ · hr | Appearance and Surface Condition of Plating Deposit | Ease of Removal of Resist Film (Degree of Remaining Resist Film) |
|---|---|---|---|
| | | Bath According to This Invention | |
| | | smooth, lustrous | |
| 5 | 4.3 | Slightly bright copper color, smooth, lustrous | Completely removed after washing twice |

TABLE 2

| Times of Plating | Deposition Rate mg/cm$^2$ · hr | Appearance and Surface Condition of Plating Deposit | Ease of Removal of Resist Film (Degree of Remaining Resist Film) |
|---|---|---|---|
| | | Reference Bath (I) | |
| 1 | 6.5 | Dark brown, mat-like, non-lustrous | Partially remained after washing two or three times |
| 2 | 6.45 | Dark brown, mat-like, non-lustrous | Partially remained after washing two or three times |
| 3 | 6.4 | Dark brown, mat-like, non-lustrous | Partially remained after washing two or three times |
| 4 | 6.4 | Dark brown, mat-like, non-lustrous | Partially remained after washing two or three times |
| 5 | 6.4 | Dark brown, mat-like, non-lustrous | Partially remained after washing two or three times |

TABLE 3

| Times of Plating | Deposition Rate mg/cm$^2$ · hr | Appearance and Surface Condition of Plating Deposit | Ease of Removal of Resist Film (Degree of Remaining Resist Film) |
|---|---|---|---|
| | | Reference Bath (II) | |
| 1 | 4.5 | Slightly bright copper color, smooth, lustrous | Completely removed after washing twice |
| 2 | 6.0 | Mat-like, non-lustrous | Partially remained after washing two or three times |
| 3 | 6.8 | Mat-like, non-lustrous, partially-like | Partially remained after washing two or three times |
| 4 | Bath decomposition | Rough deposition | — |

From the results described above, it has been found that, in the bath according to this invention containing both sarcosine and potassium ferrocyanide, the deposition rate is almost constant, the appearance and the surface condition of the deposit are excellent and removal of the resist film is secured by washing it once or twice.

In contrast, in reference bath (I) without potassium ferrocyanide and triethanolamine, the appearance and the surface condition of the deposit were inferior and washing must be repeated several times in removing the resist film. In reference bath (II), it was not enabled to control the deposition rate, the appearance and the surface condition of the deposit were easily varied and there were variations in ease of removal of the resist film.

In the following, the effectiveness of control of free formaldehyde in the plating bath containing formaldehyde and a compound which can react with formaldehyde to form an addition product, will be explained according to the following example.

EXAMPLE 5

An electroless copper plating solution of the following composition was prepared.

| | |
|---|---|
| $CuSO_4.5H_2O$ | 0.04 mole/l |
| EDTA.4Na | 0.08 mole/l |
| Glycine | 0.04–0.10 mole/l |
| Formaldehyde | 0.06–0.12 mole/l |
| pH | 12.5 |

Figure 6:
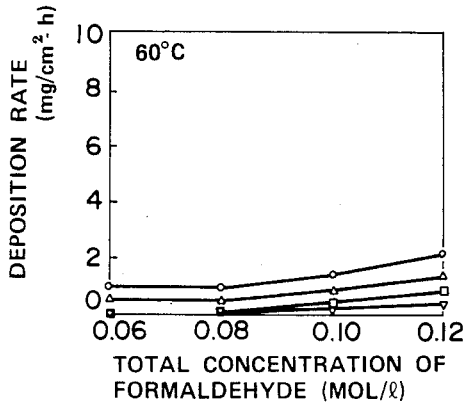
FIGS. 6 are graphs indicating the relationship between the total concentration of formaldehyde in electroless copper plating solution and the deposition rate.
Figure 6:
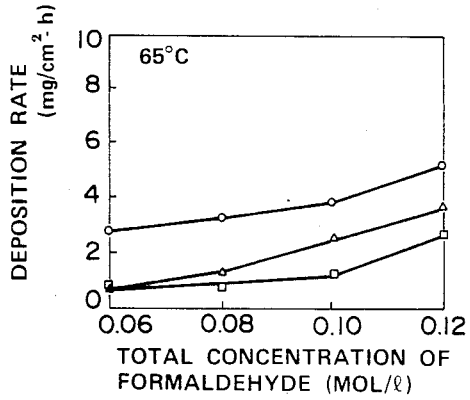
Figure 6:
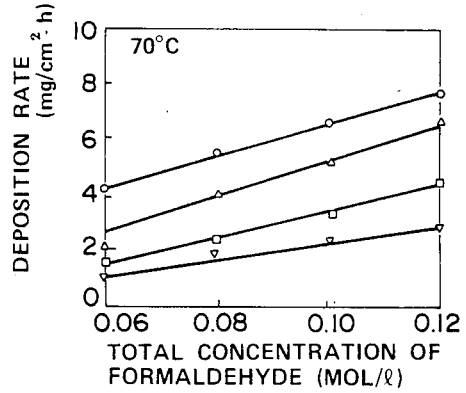
Figure 7:
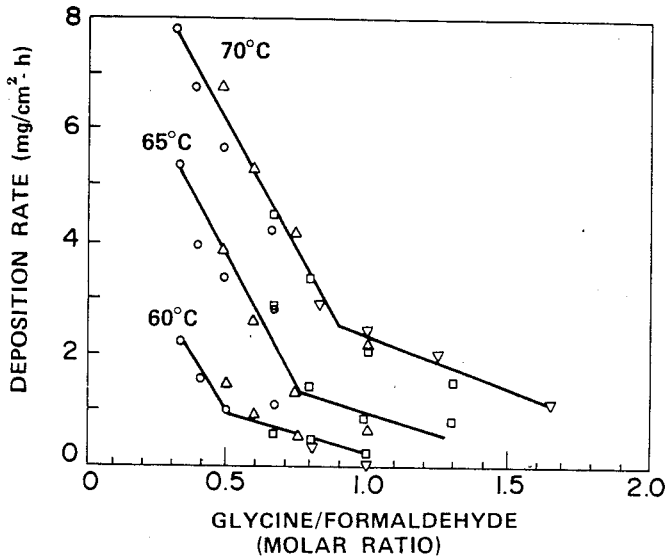
FIG. 7 is a graph indicating the relationship between the molar ratio of glycine to formaldehyde and the deposition rate.
Figure 8:
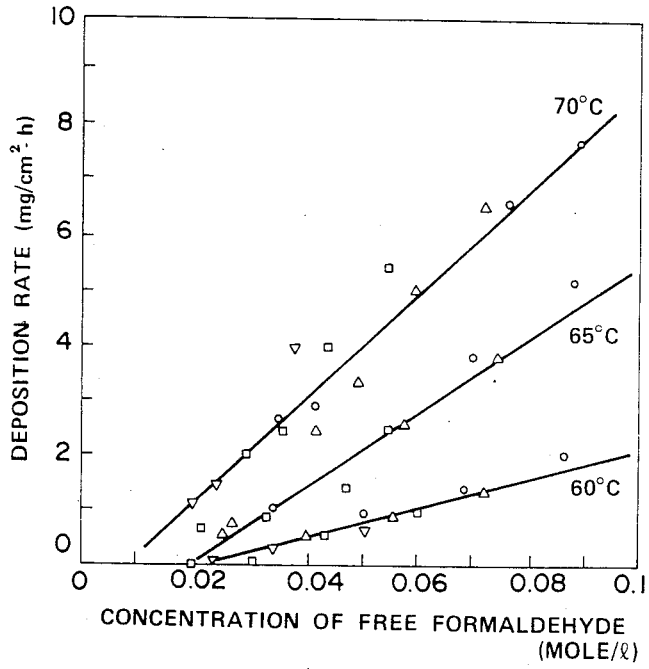
FIG. 8 is a graph indicating the relationship between the concentration of free formaldehyde and the deposition rate.

Next, a copper plate of 2×2 cm$^2$ used as a test piece was subjected to electroless copper plating at a given temperature for 20 minutes, and the deposition rate was obtained from the change in weight of the copper plate. The relationship between the concentration of formaldehyde and the deposition rate is shown in FIGS. 6 (1)–(3); that between the molar ratio of glycine to formaldehyde and the deposition rate, in FIG. 7; and that between the concentration of free formaldehyde and the deposition rate, in FIG. 8. The concentration of free formaldehyde was measured by polarography.

In these figures, the circular, the triangular, the square and the reverse triangular marks, respectively, indicate the glycine concentration is 0.04 mole/1, 0.06 mole/1, 0.08 mole/1 and 0.10 mole/1.

Figure 9:
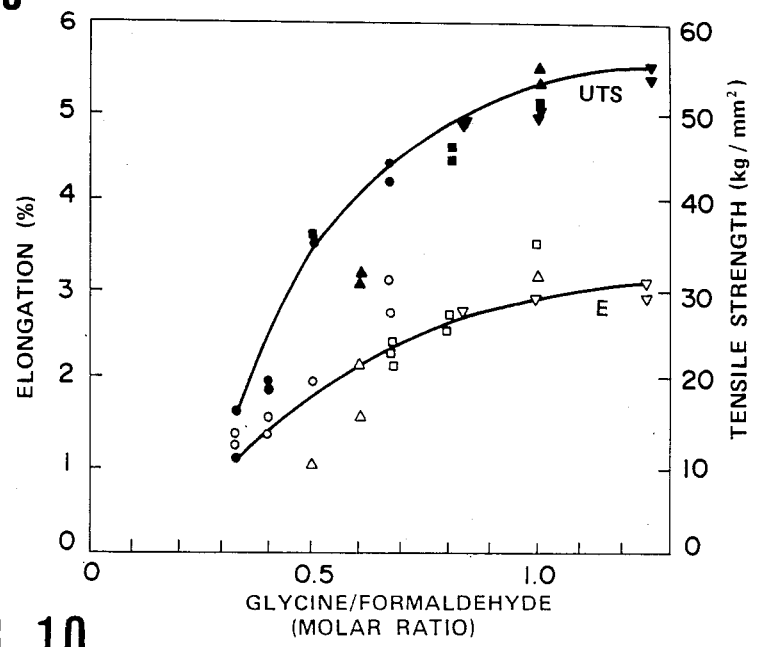
FIG. 9 is a graph indicating the relationships between the molar ratio of glycine to formaldehyde and the elongation percentage and the tensile strength of the deposit.
Figure 10:
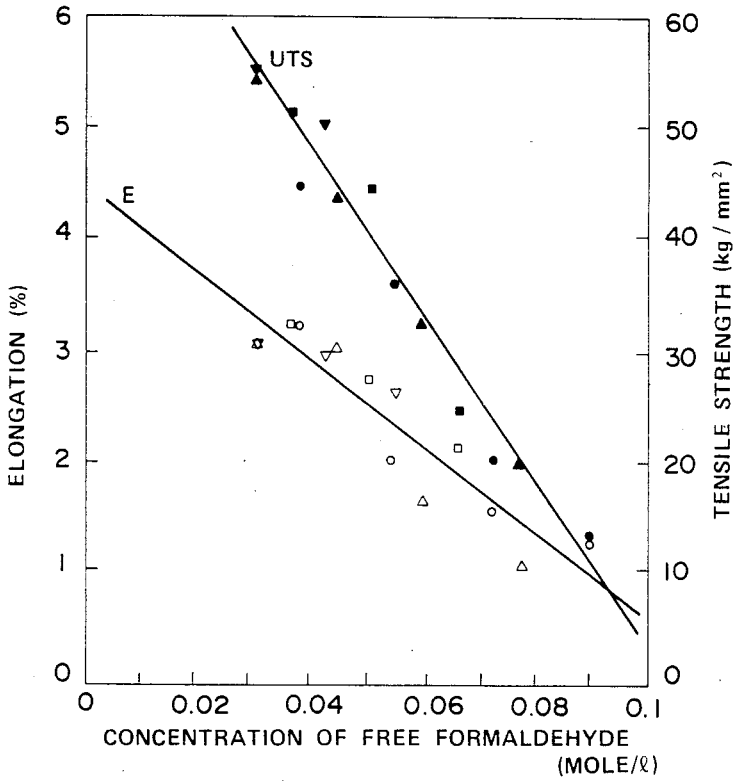
FIG. 10 is a graph indicating the relationships between the concentration of free formaldehyde and the elongation percentage and the tensile strength of the deposit.
Figure 11:
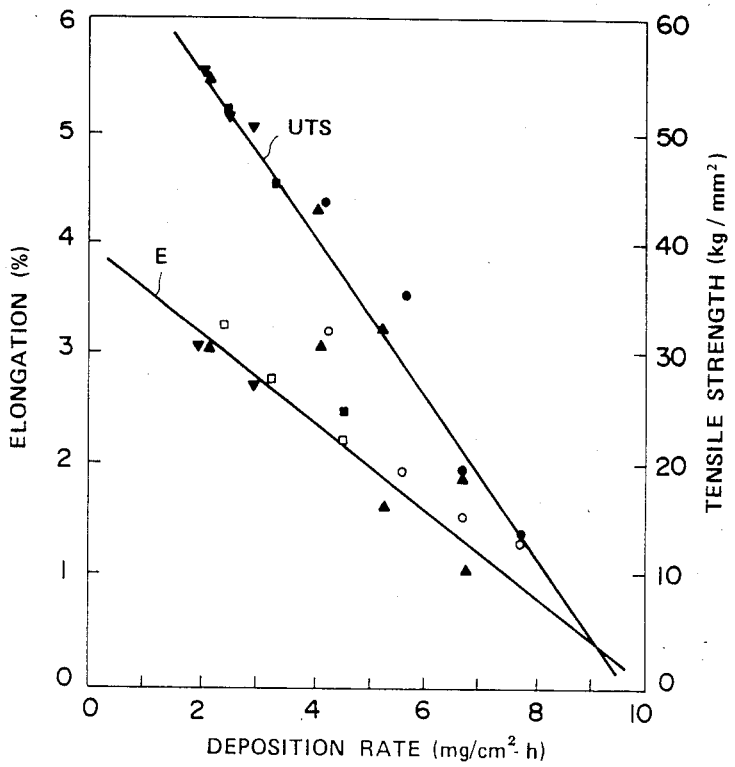
FIG. 11 is a graph indicating the relationships between the deposition rate and the elongation percentage and the tensile strength of the deposit.

Next, an acrylic plate of 2×8 cm$^2$ used as a test piece, after being activated by the usual method (palladium metal adhesion treatment), is subjected to electroless copper plating by means of the above plating solution at 70° C. to form a deposit of 25 to 30 μm thickness. The elongation and the tensile strength of the thus formed deposit were investigated by a tensile test. The relationships between the molar ratio of glycine to formalin and the elongation and the tensile strength are shown in FIG. 9, while the relationships between the concentration of free formalin and the elongation and the tensile strength are shown in FIG. 10. In these figures, the symbol (E) represents elongation and the symbol (UTS) represents tensile strength. In addition, the relationships between the deposition rate and the elongation and the tensile strength are indicated in FIG. 11.

According to the above results observed, in the plating solution containing the compound which can react with formaldehyde to form an addition compound, the deposition rate and the physical properties of the deposit (elongation and tensile strength) are in almost linear relationship with the concentration of free formaldehyde. Therefore in such plating solution, the deposition rate and the physical properties can be much more easily. controlled through control of the concentration of free formaldehyde than through control of the molar ratio of the compound which can react with formaldehyde to form an addition product to formaldehyde. That is to say, it has been found that the deposition rate and the physical properties depend on the concentration of free formaldehyde irrespective of the concentration of total formaldehyde, the concentration of the compound which can react with formaldehyde to form an addition product and the molar ratio of these compounds. Therefore, the deposition rate and the physical properties can be easily estimated from the concentration of free formaldehyde, and easy maintenance of constant levels of the deposition rate and the physical properties are secured by maintaining the concentration of free formaldehyde at a constant level. Furthermore, as clearly seen from FIG. 11, the deposition rate and the physical properties are in almost linear interrelation in the plating solution containing the compound which can react with formaldehyde to form an addition product. Therefore, the desired deposition rate or physical properties of the deposit can be freely selected by varying the concentration of free formaldehyde, and electroless copper plating can be quite easily controlled according to the requirements of an article to be plated through control of the concentration of free formaldehyde.

In the following, possible examples of controlling the pH of electroless copper plating solution through measurement of its absorbance will be tangibly shown.

EXAMPLE 6

| | |
|---|---|
| $CuSO_4.5H_2O$ | 0.04 mole/l |
| EDTA.4Na | 0.08 mole/l |

After preparing solution of the above composition, its pH was adjusted to various levels by means of NaOH and $H_2SO_4$.

Figure 12:
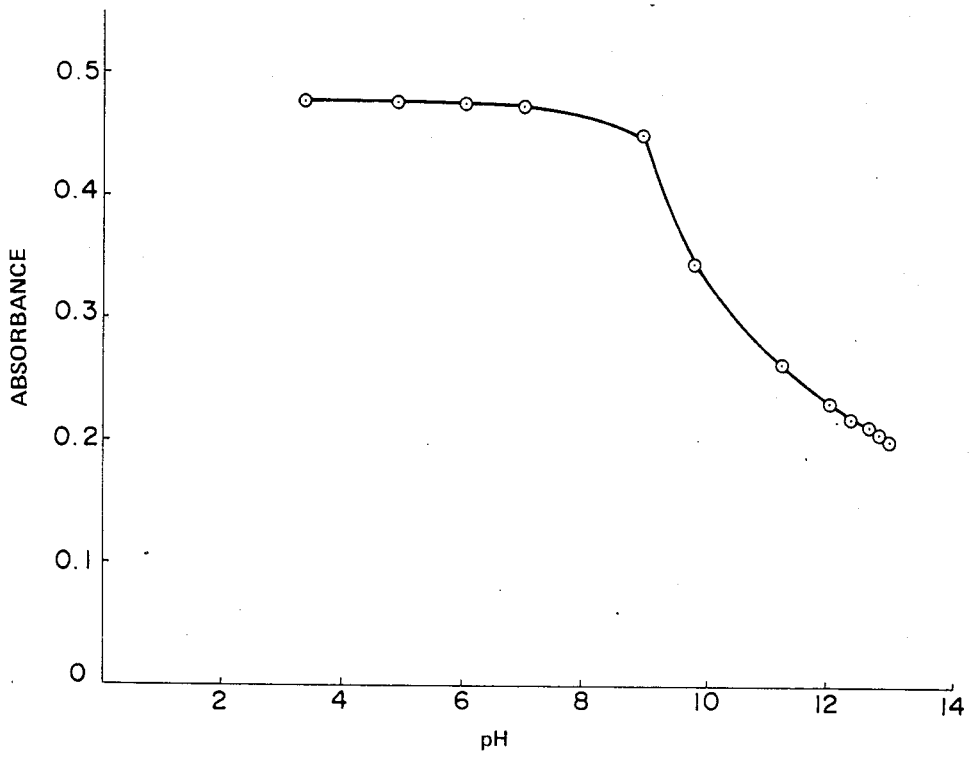
FIGS. 12 and 13 are graphs indicating the relationship between the absorbance and the pH of solution containing the copper-EDTA.4Na complex.
Figure 13:
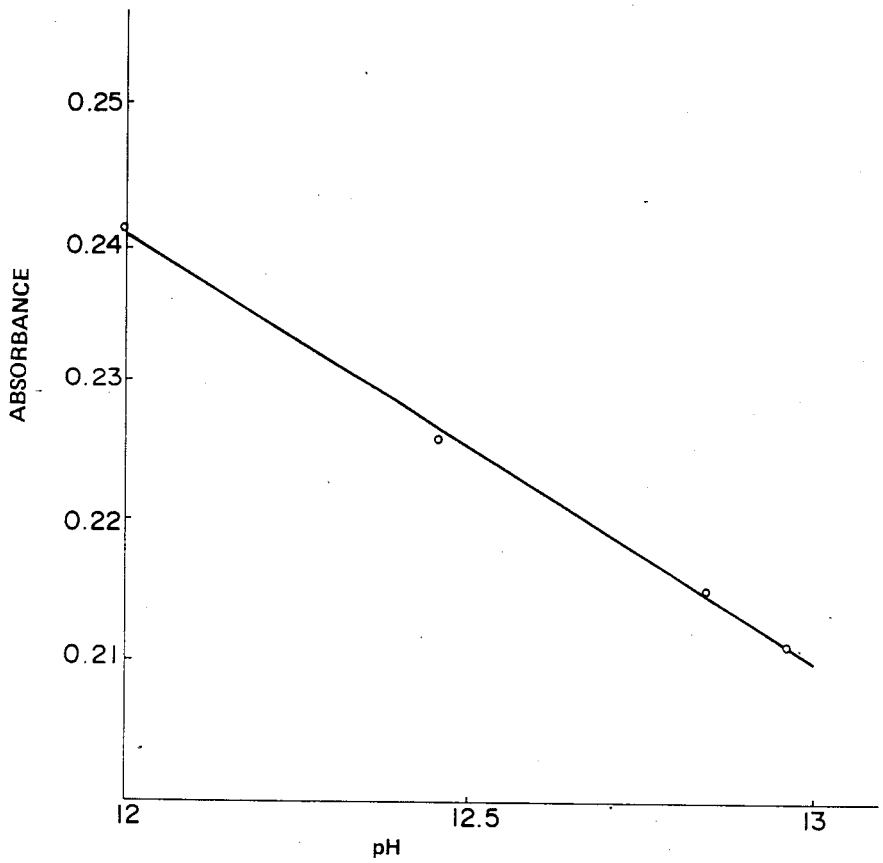

Next, the absorbance and the pH levels of thus prepared solutions were measured thereby obtaining results shown in FIGS. 12 and 13.

The absorbance was measured with a Hitachi double-beam spectrophotometer 124 at a wavelength of 730 nm by use of a 1 mm cell. The pH was measured with a Hitachi-Horiba F-7II pH meter. From the results shown in FIGS. 12 and 13, it has been observed that the absorbance level and the pH level of the solution are in almost linear interrelation at a pH higher than 8, especially at a pH not lower than 9. In addition, since the absorbance level is almost constant at a pH below 8, copper ion concentration can be quantitatively analysed effectively at a pH below 8 by an absorbance-measuring method.

EXAMPLE 7

| | |
|---|---|
| $CuSO_4.5H_2O$ | 0.04 mole/l |
| EDTA.4Na | 0.08 mole/l |
| Formalin | 0.08 mole/l |
| Glycine | 0.06 mole/l |
| pH | 12.5 (measured with a pH meter) |

The absorbance of an electroless copper plating solution of the above composition was measured at a wavelength of 730 nm (with the said absorbance-measuring device, 1 mm cell). From the thus obtained absorbance of 0.225, the pH of the plating solution was determined to be 12.5 according to a calibration curve shown in FIG. 13. Accordingly, it has been found that the pH level obtained through absorbance measurement coincides with the pH level obtained with a pH meter.

What is claimed is:

1. An electroless copper plating bath, comprising:

a cupric ion complexing agent for complexing cupric ion wherein the cupric ion complexing agent is an ethylenediamine derivative selected from the group consisting of ethylenediaminetetraacetic acid, tetrahydroxy propyl ethylenediamine, N-hydroxy ethyl ethylenediaminetriacetic acid and salts thereof;

a reducing agent;

a metal-cyano-complex stabilizer; and a metal complexing agent for complexing the metal of said metal-cyano-complex.

2. The electroless copper plating bath as set forth in claim 1, wherein the ethylenediamine derivative is ethylenediaminetetraacetic acid or a salt thereof.

3. The electroless copper plating bath as set forth in claim 1, wherein the reducing agent is formaldehyde or a derivative thereof.

4. The electroless copper plating bath as set forth in claim 1, wherein the concentration of cupric ion is 0.01 to 1 mole/l, the molar concentration of the cupric-ion-complexing agent is equal to or higher than the molar concentration of cupric ion and the concentration of the reducing agent is 0.02 to 0.5 mole/l.

5. The electroless copper plating bath as set forth in claim 1, wherein the metal-cyano-complex is selected from the group consisting of an alkali metal ferrocyanide, ammonium ferrocyanide, an alkali metal nickelcyanide, ammonium nickelcyanide, an alkali metal cobaltcyanide, ammonium, cobaltcyanide and mixtures thereof, and the agent for complexing the metal of the metal-cyano-complex is an alkanol amine.

6. The electroless copper plating bath as set forth in claim 1, wherein the concentration of the metal-cyano-complex is $1\times10^{-5}$ to $5\times10^{-2}$ mole/l and the molar concentration of the metal complexing agent for complexing the metal of the metal-cyano-complex is equal to or higher than the molar concentration of the metal-cyano-complex.

7. The electroless copper plating bath as set forth in claim 1, wherein a water-soluble nitrogen compound having at least two polar groups is added and at least one of the polar groups is a —$NH_2$ group or a=NH group which can react with formaldehyde or a derivative thereof to form an addition product.

8. The electroless copper plating bath as set forth in claim 7, wherein the water-soluble nitrogen compound is an aliphatic compound having the —$NH_2$ group or the =NH group and a —COOH group.

9. The electroless copper plating bath as set forth in claim 7, wherein the concentration of the water-soluble nitrogen compound is 0.1 to 2 moles per one mole quantity of total formaldehyde.

10. An electroless copper plating method comprising immersing an article to be plated in the bath of claim 1.

11. An electroless copper plating method comprising immersing an article to be plated in the bath of claim 2, determining the pH or alkalinity of the plating bath from both the absorbance of the plating bath of a pH level higher than 8 and concentration of copper ion in the plating bath, and delivering a signal when the determined pH or alkalinity is lower than a set pH or alkalinity level.

12. The electroless copper plating method as set forth in claim 11, wherein the concentration of copper ion in the plating bath is determined by measuring the absorbence of the plating bath adjusted to a pH level of below 8 by addition of acid.

13. The electroless copper plating method comprising immersing an article to be plated in the bath of claim 7.

14. The electroless copper plating method as set forth in claim 13, which comprises maintaining the deposition rate of said electroless copper plating and the physical properties of the deposit at given levels by maintaining the concentration of free formaldehyde a given level.

15. The electroless copper plating bath according to claim 1, wherein the concentration of cupric ion is 0.02 to 0.5 mole/1, the molar concentration of the cupric ion complexing agent is equal to or higher than the molar concentration of cupric ion and the concentration of the reducing agent is 0.02 to 0.1 mole/1.

16. The bath according to claim 1, comprising a stabilizer in addition to the metal-cyano-complex having a nitrogen atom which can bind to cuprous ion to form a complex.

17. The electrOless copper plating bath according to claim 16, wherein the stabilizer is selected from the group consisting of cyanides, thiocyanates, pyridyl derivatives, phenantroline and its derivatives and organic nitriles.

18. The electroless copper plating bath according to claim 16, wherein the stabilizer is selected from the group consisting of sodium cyanide, potassium cyanide, $\alpha,\alpha'$-dipridyl and 2,9-dimethyl-1,10-phenantroline.

19. The electroless copper plating bath according to claim 7, wherein the nitrogen compound for 1 mole of total formaldehyde is 0.4 to 1.2 moles.

20. The electroless copper plating bath according to claim 1, wherein the pH is within the range of 11.5 to 12.5.

21. The electroless copper plating bath according to claim 1, wherein the deposition rate is within the range of 1 to 6 $\mu$m/h.

22. An electroless copper plating bath, comprising:

cupric ion;

a cupric ion complexing agent for complexing cupric ion wherein the cupric ion complexing agent is selected from the group consisting of diethylenetriaminetriacetic acid, diethylenetriaminepentaacetic acid, nitrotriacetic acid. cyclohexylenediaminetetraacetic acid, citric acid, tataric acid and the salts thereof;

a reducing agent;

a metal-cyano-complex stabilizer; and a metal complexing agent for complexing the metal of said metal-cyano-complex.

23. An electroless copper plating bath, comprising cupric ion;

a cupric ion complexing agent for complexing cupric ion;

a reducing agent;

$1\times10^{-5}$ to $5\times10^{-2}$ mole/1 of a metal-cyano-complex stabilizer selected from the group consisting of an alkali metal ferrocyanide, ammonium ferrocyanide, an alkali metal nickelcyanide, ammonium nickelcyanide, an alkali metal cobaltcyanide, ammonium cobaltcyanide and mixtures thereof; and an alkanol amine for complexing a metal of the metal-cyano-complex, wherein the molar concentration of the alkanol amine is one to three times the molar concentration of the metal-cyano-complex.

24. An electroless copper plating bath, comprising:

cupric ion;

a cupric ion complexing agent for complexing cupric ion;

a reducing agent;

a metal cyano-complex stabilizer; and an alkanol amine for complexing the metal of said metal-cyano-complex:

25. The electroless copper plating bath according to claim 24, wherein the molar concentration of tbe alkanol amine is one to three times the molar concentration of a metal-cyano-complex.

26. The electroless copper plating bath according to claim 24, wherein the metal-cyano-complex stabilizer is selected from the group consisting of alkali metal ferrocyanide, ammonium ferrocyanide, an alkali metal nickelcyanide, ammonium nickelcyanide, an alkali metaL cobaltcyanide, ammonium colbaltcyanide and mixtures thereof.

* * * * *